US011814898B2

(12) United States Patent
Falzon

(10) Patent No.: US 11,814,898 B2
(45) Date of Patent: Nov. 14, 2023

(54) RELATION TO LADDER STABILISATION

(71) Applicant: Joseph Emanuel Falzon, Boronia Heights (AU)

(72) Inventor: Joseph Emanuel Falzon, Boronia Heights (AU)

( * ) Notice: Subject to any disclaimer, the term of this patent is extended or adjusted under 35 U.S.C. 154(b) by 0 days.

(21) Appl. No.: 17/702,685

(22) Filed: Mar. 23, 2022

(65) Prior Publication Data

US 2023/0131374 A1 Apr. 27, 2023

(30) Foreign Application Priority Data

Oct. 25, 2021 (AU) ..... 2021903400

(51) Int. Cl.
*E06C 7/42* (2006.01)
*E06C 7/44* (2006.01)

(52) U.S. Cl.
CPC ..... *E06C 7/423* (2013.01); *E06C 7/42* (2013.01); *E06C 7/426* (2013.01); *E06C 7/44* (2013.01)

(58) Field of Classification Search
CPC ... E06C 7/44; E06C 7/426; E06C 7/48; E06C 7/423; E06C 7/42
USPC ..... 182/107
See application file for complete search history.

(56) References Cited

U.S. PATENT DOCUMENTS 530,374 A 12/1894 Wilkins
776,446 A 11/1904 Williamson
1,462,505 A * 7/1923 Hunt ..... E06C 7/44 182/201
1,676,618 A 7/1928 Morris
2,327,317 A 8/1943 Randall
2,620,115 A * 12/1952 Guldjord ..... E06C 7/44 182/109
2,634,037 A * 4/1953 Bortel ..... E06C 7/42 182/180.3
2,652,937 A * 9/1953 Cutler ..... E06C 7/48 187/401
3,618,703 A 11/1971 Wilke
3,920,097 A * 11/1975 Brebner ..... E06C 7/426 182/107
3,929,208 A * 12/1975 Hendrich ..... E06C 7/48 182/108

(Continued)

FOREIGN PATENT DOCUMENTS

DE 3505914 A1 8/1986
DE 202007001250 U1 * 5/2007 ..... E06C 7/426

(Continued)

*Primary Examiner* — Taylor Morris
(74) *Attorney, Agent, or Firm* — Bonini IP Law, LLC; Frank J. Bonini, Jr.

(57) ABSTRACT

A ladder stabilizer where respective ladder rails 12 and 13 pass through rail clamp sections 14 and 15 so that the feet 16 and 17 of the ladder engage the ground. The stabilizer has feet 18 and 19 which also engage the ground. These are at the end of a rail providing respective outriggers 20 and 21 so that the stabilizing forces and moments are across the bottom of the ladder. Clamps make the whole stabilizer and ladder rigid. Rails 12 and 13 are clamped in the clamp sections 14 and 15 which are in turn clamped along the outriggers, the feet are also clamped in height adjustable position. Hand operable screw clamps 22, 23, 24, 25, 26 and 27 permit adjustment so that the legs and rails and clamp sections may be positioned to best stabilize the ladder 11.

11 Claims, 5 Drawing Sheets

(56) References Cited

U.S. PATENT DOCUMENTS

| | | | | | |
|---|---|---|---|---|---|
| 3,937,298 | A | | 2/1976 | Hurwitz | |
| 4,069,893 | A | | 1/1978 | Blackstone | |
| 4,143,742 | A | * | 3/1979 | Fernandez | E06C 7/44 182/201 |
| 4,469,193 | A | | 9/1984 | Rumsey, Jr. | |
| 4,502,566 | A | * | 3/1985 | Wing | E06C 7/48 182/214 |
| 4,679,652 | A | * | 7/1987 | Cervantes, Sr. | E06C 7/426 182/200 |
| 4,765,439 | A | * | 8/1988 | Kresmery | E06C 7/48 182/206 |
| 5,082,088 | A | | 1/1992 | Krause | |
| 5,121,814 | A | * | 6/1992 | Southern | E06C 7/482 248/210 |
| 5,423,397 | A | * | 6/1995 | Boughner | E06C 7/44 182/172 |
| 5,476,153 | A | * | 12/1995 | Dickerson | E06C 7/44 182/108 |
| 5,507,364 | A | * | 4/1996 | Spevak | E06C 7/44 182/200 |
| 5,551,529 | A | * | 9/1996 | Molitor | E06C 7/44 182/204 |
| 5,918,698 | A | | 7/1999 | Lunn | |
| 6,009,974 | A | * | 1/2000 | Jones | E06C 7/48 182/214 |
| 6,053,284 | A | * | 4/2000 | Fountain | E06C 7/423 182/180.2 |
| 6,382,353 | B2 | | 5/2002 | Laug | |
| 6,629,582 | B2 | | 10/2003 | Barnett | |
| 6,655,497 | B1 | | 12/2003 | Weatherall | |
| 7,424,933 | B2 | | 9/2008 | Weiss | |
| 8,602,162 | B2 | | 12/2013 | Dondurur et al. | |
| 9,556,675 | B2 | * | 1/2017 | Reyes | F16M 11/38 |
| 2002/0134619 | A1 | * | 9/2002 | Schwenke | E06C 1/34 182/107 |
| 2005/0023084 | A1 | * | 2/2005 | Lazarus | E06C 7/482 182/214 |
| 2006/0207832 | A1 | | 9/2006 | Gardner et al. | |
| 2008/0000721 | A1 | | 1/2008 | Deal | |
| 2008/0011549 | A1 | * | 1/2008 | Lott | E06C 7/42 182/217 |
| 2009/0101437 | A1 | * | 4/2009 | Abraham | E06C 7/08 16/29 |
| 2010/0038172 | A1 | | 2/2010 | Ralston | |
| 2011/0088971 | A1 | * | 4/2011 | Jaffe | E06C 7/16 182/178.3 |
| 2014/0027605 | A1 | * | 1/2014 | Chow | E06C 7/426 248/689 |
| 2015/0252620 | A1 | | 9/2015 | Walsh | |
| 2017/0198522 | A1 | | 7/2017 | Stewart | |
| 2018/0340371 | A1 | | 11/2018 | Georges | |
| 2019/0055784 | A1 | * | 2/2019 | Kazanjian | E06C 7/44 |
| 2020/0087985 | A1 | | 3/2020 | Polzen | |
| 2020/0095827 | A1 | * | 3/2020 | Skelborn | E06C 7/003 |
| 2020/0149348 | A1 | | 5/2020 | Khwaja | |

FOREIGN PATENT DOCUMENTS

| | | | | | |
|---|---|---|---|---|---|
| FR | 1012129 | A | * | 7/1952 | E06C 7/42 |
| GB | 2115474 | A | * | 9/1983 | E06C 7/42 |
| GB | 2458327 | A | * | 9/2009 | E06C 7/42 |
| SE | 533948 | C2 | | 3/2011 | |

* cited by examiner

RELATION TO LADDER STABILISATION

TECHNICAL FIELD

THIS INVENTION relates to improvements in or in relation to ladder stabilization and in particular but not limited ground engaging ladder stabilization.

BACKGROUND

Ladders are extraordinarily common. Most households have a ladder. The most common is the step ladder which has hinged legs in a self sustaining A-configuration. These are commonly made rotatable about the hinge to an end on end configuration, convertible and lockable as a long ladder that may be leaned up against a building. They are therefore dual purpose. There are also extension ladders that are also used in this way to lean up against a building or other structure in an inclined position. These extension ladders may be quite long and are more often used by trades people. For example, an electrician would usually have a step ladder and an extension ladder. A step ladder would often be used for interior work while the extension ladder would be used for exterior high level work. Falls from ladders can and often do result in serious injuries and/or damaged property. In addition to injured personnel either falling from the ladder or being hit by a falling ladder there is also damage to property including wall damage, broken windows etc. Falls that do not result in serious injuries are common and go unreported, most ladder users can recount an accident involving a ladder. Overconfidence, improper use or simply uneven ground are often the culprits leading to accidents.

Now having said all this, the potential for these situations to arise have been around ever since humans have used some form of climbing aid, scaffold, ladder or the like. Ladders have been around for millenia involving a very simple arrangement of parallel rails and rungs. Devices to stabilize ladders have been around for just as long since these stability problems and safety problems discussed above have also been around for as long as the ladders.

It should be very clear that the art of ladder stabilization and safety devices is a very mature one.

Indeed there are whole sections of the US Patent Classification and International Patent Classification devoted to this subject. Non-exhaustive examples of ladder stabilization methods and devices are set out in the following patent specifications: US2020/0149348; U52020/0087985; U52018/0340371; U52017/0198522; U52015/0252620; U52010/038172; U52008/0000721; U52006/0207832; U.S. Pat. Nos. 6,655,497; 5,918,698; 5,082,088; 4,069,893; 2,327,317; 8,602,162; 7,424,933; 6,629,582; 6,382,353; 4,469,193; 3,937,298; 3,618,703; 1,676,618; US776,446; US530,374; SE 533948; DE3505914.

The Applicant's invention should be viewed through the lens of a crowded art in order to demonstrate that in all the circumstances the notional skilled person would be presented with many similar solutions to the problem of ladder stabilization. Since the present invention arises in a crowded art it would be prima facie wrong to suggest that there was, or is, apart from the very general problem of ladder stabilization, that there was any a particular problem or motivation extant at the filing date of the present application that would give rise to the non-inventive notional person coming up with the present invention and its improvements either in idea, concept or practical form. Thus the recognition and the present conception may be considered as whole or part of the Applicant's inventive step.

With this and the other background factors, including as set out above, in mind, it should be clearly appreciated to the reader, that it is elementary that exercise of the inventive faculty in all the circumstances, in such a crowded art, is likely to be present in small variations. This is a background observation in hindsight only and is not to say that any of Applicant's new features whether individually or in combination are in any way slight or small. All that is required is a "scintilla" of invention.

Even though the art has become crowded, the later offerings have not been widely accepted. Consequently, there is a requirement for a fresh look at the general problems, and to look "outside the box", through new eyes in an effort to provide an alternative to the efforts made over the last many years. It would be desirable to have something that is simple and easy to assemble, yet effective.

Outline

In the present specification a ladder does not form part of the invention but when referring to the components of a ladder, the terms legs and rails and the terms steps, treads and rungs, as with other conventional parts with other differing terminology should be considered equivalent.

In one broad aspect the invention is provided in a ladder stabilizer comprising, spaced apart leg or rail receiving clamp sections, bilateral outriggers extending from the rail receiving clamp sections, each outrigger having at least one ground engaging foot, each ground engaging foot being height adjustable, the stabilizer being so dimensioned and arranged that rails of a ladder may be clamped in the clamp sections so that the outriggers and feet stabilize the ladder against titling. In use the ladder has a top and a bottom and the outriggers and feet stabilize the ladder against titling by providing bilateral resistive forces and moments extending substantially along a line across the bottom of the ladder.

The applicant has devised a number of additional independent improvements in the ladder stabilizer as broadly described above which may be employed individually but also combine and interact to useful effect so each should be considered individually and in combination.

In one improvement there is provided a ladder stabilizer being further characterised in that, the stabilizer has manually operable and slidable components and clamps, these being so made and arranged that the components and clamps are non-removable. The expression "non-removable" is used in the context of preventing accidental loss of parts so it is preferred that the whole be a unit, assembled so that it may not be taken apart in the usual course of events. This does not mean that it is of a unitary integral construction, parts may be assembled from separate parts and for example bolted together so that if one really put their mind to it in a deliberate way then it could be dismantled but it is intended to be permanently assembled and the parts non-removable.

In another improvement there is provided spaced apart rail clamp sections that have rail pass though passage means so that a rail may pass through and contact the ground. Typically the rail clamp section is oversized so different size rails may be accommodated. Typically, the rail clamp sections have a narrow upper neck with sideways clamps apply an axial clamp force so that the stabilizer may tilt relative to the ladder axis and be clamped to the rails. Typically this tilt is a maximum of about 12°-14°. In this case the legs are regulated to accommodate the tilt.

In another improvement, the rail clamp sections are laterally sildable. Preferably, the rail clamp sections are able to freely slide along an axial guideway. Typically, the rail clamp section has an oversized guide fitted to a smaller guideway which permits the free slide action until the guide is clamped to the guideway. Once clamped it becomes rigid. The gap in the clamp side may be quite small. Preferably, each rail clamp section has two hand clamps, such that one is operatively on each side of a rail.

In a further improvement, the feet are at the ends of respective slidable legs, sliding in a leg guideway. Preferably the legs freely slide in an oversized guideway so that they may wobble slightly until clamped.

In each case the guideways are oversized in the direction of the applied clamp force.

BRIEF DESCRIPTION OF THE DRAWINGS

In order that the present improvements may be more readily understood and put into practical effect reference will now be made to the accompanying drawings which illustrate preferred embodiments of the invention and wherein:—

METHOD OF PERFORMANCE

Figure 1:
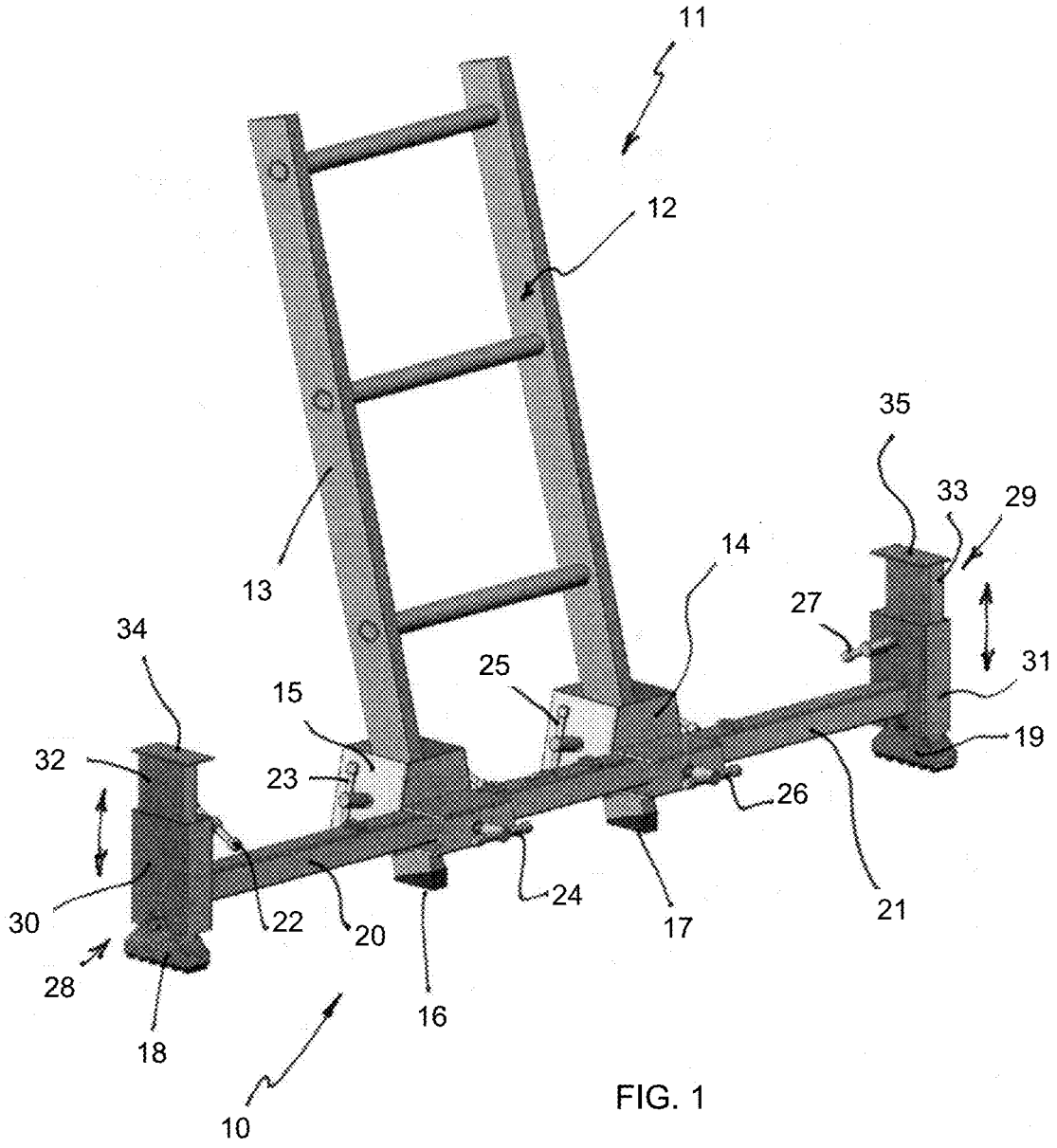
FIG. 1 is a pictorial illustration of a ladder stabilizer according to the invention with a ladder secured in position.

Referring to the drawings and initially to FIG. 1 there is illustrated a ladder stabilizer 10 shown stabilizing a ladder 11 where respective ladder rails 12 and 13 pass through rail clamp sections 14 and 15 so that the feet 16 and 17 of the ladder engage the ground. The stabilizer has feet 18 and 19 which also engage the ground. These are at the end of a rail providing respective outriggers 20 and 21 so that the stabilizing forces and moments are across the bottom of the ladder. Clamps to be described and various other clamps make the whole stabilizer and ladder rigid. It will be appreciated that the rails 12 and 13 are clamped in the clamp sections 14 and 15 which are in turn clamped along the outriggers, the feet are also clamped in height adjustable position. This may clearly be seen from the drawing of FIG. 1. To this end there are hand operable screw clamps 22, 23, 24, 25, 26 and 27 that permit adjustment so that the legs and rails and clamp sections may be positioned to best stabilize the ladder 11.

Each foot assembly 28, 29 includes an outer guideway in the form of a collar 30 welded and 31 welded to the outriggers and slidable leg sections 32, 33. The leg sections have a respective pivoting foot 18,19 and a cap 34, 35 so that the foot 18, 19 and caps 34,35 prevent the post part 32, 33 from being removed from the guide collar. This means it is non-removable. Likewise each of the rail clamp sections are housing slidable along the outriggers by reason of collars 36, 37 and this is integral in construction so that these cannot be removed from the stabilizer. Thus all these moveable and slidable parts of the stabilizer cannot become detached and accidentally lost. Each of the hand screw clamps likewise cannot be removed from their operative position and these are the typical form of clamp of the type having a pivoting head a pivoting head so again once these are assembled they cannot be inadvertently lost.

Figure 3:
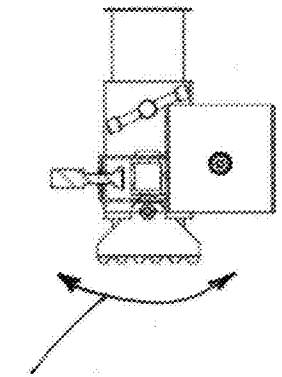
FIGS. 2, 3 and 4 are respective front section through 33 of FIG. 2 and top views of the ladder stabilizer of FIG. 1.
Figure 2:
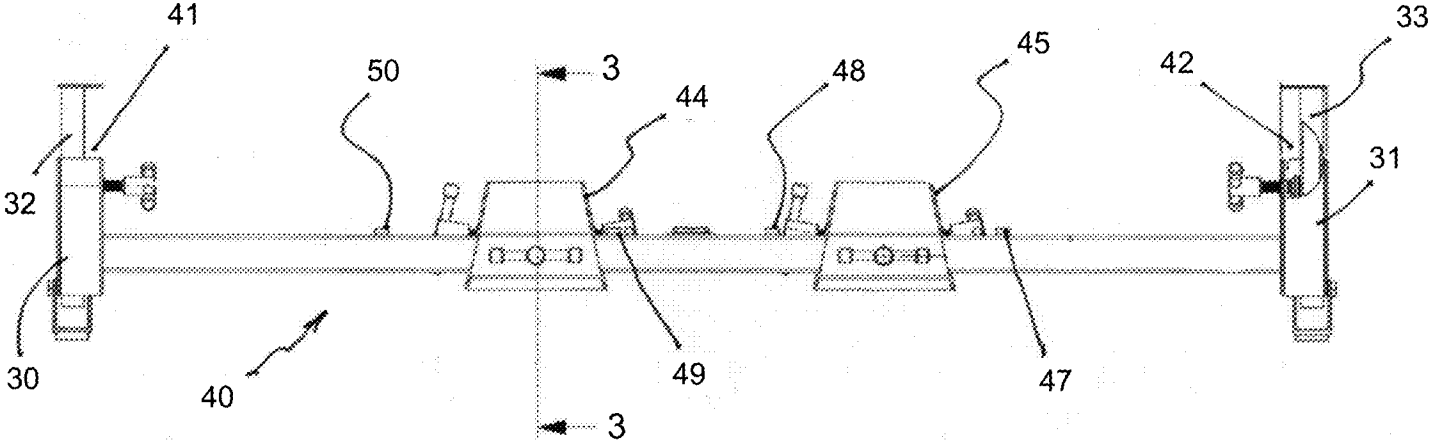
Figure 4:
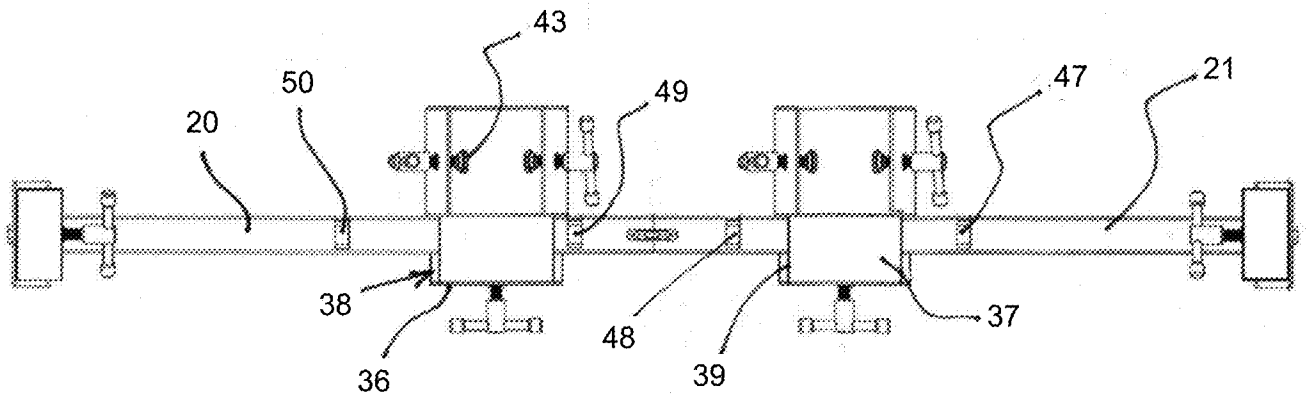

Referring now to FIGS. 2 to 4 like numerals illustrate like features, the rail receiving collars are trapezium prismatic in shape as can be seen in FIG. 2, so the section of these collars in the axial direction of the outriggers is an isosceles trapezium with the parallel sides being seen in the transverse section of FIG. 3.

Each hand clamp is used to clamp from a freely sliding and wobble type relationship to clamp the parts so they are wobble free. This means there are gaps at 38 and 39 so that the rail 40 that has its end sections forming the outriggers 20 and 21 is freely slidable and may wobble in the sleeves 36, 37. Likewise there are gaps 41 and 42 so that there is play or wobble in the relationship between the leg sections 32, 33 and the collars 30, 31. This play or wobble is in the direction of the damping force.

In addition the rail clamp sections 14 and 15 are wide enough so the rails may be freely slidable until clamped.

This means the sliding parts have quite a bit of play for adjustment and fine tuning. This fine tuning also takes advantage of the pivoting heads 43 on the threaded clamps which ail have this feature. Rail clamp sections 14, 15 have trapezium pyramid clamp housings 44, 45 which set the rail clamps at an angle to the rail 40 and permits further angular adjustment of the rail 40 by up to a tilt out of the horizontal of about 14° relative to the rails where the rails remain vertical.

The feet 18, 19 may pivot automatically, see arrow 46 in FIG. 3, for any uneven ground at the location of the foot.

In use there is therefore, a course fitting and initial light clamping to the ladder and then fine adjustment and final hard clamping before use.

The rail clamp housings have hand clamps in both the non-parallel walls of the housing. The housings are freely slidable along the rail 40 until clamped. To ensure the outriggers are not set too short on one side and create an unsafe situation, limit stops 47, 48, 49 and 50 limit the travel of the housings along the rail 40.

Figure 5:
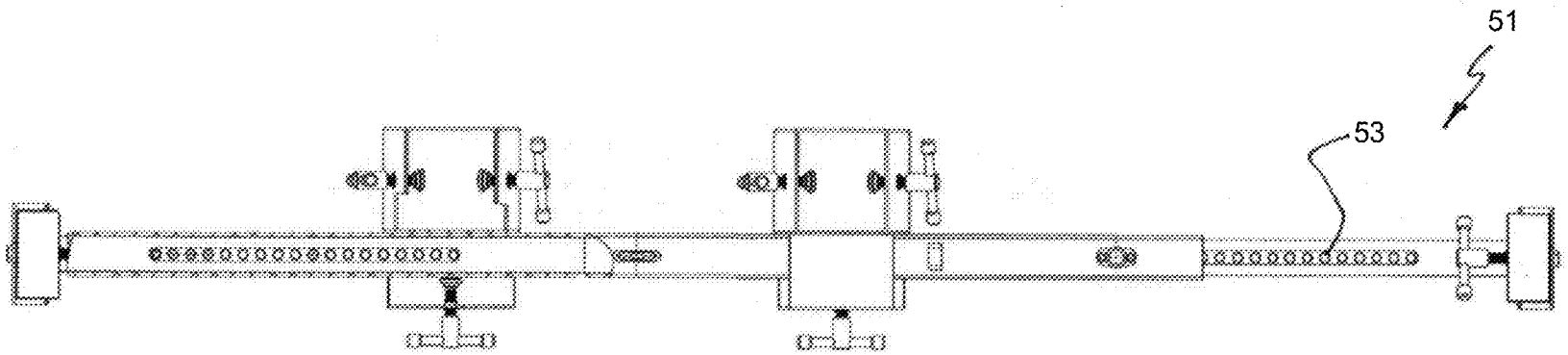
FIGS. 5 and 6 illustrate a second embodiment of the invention employing telescopic outriggers.
Figure 6:
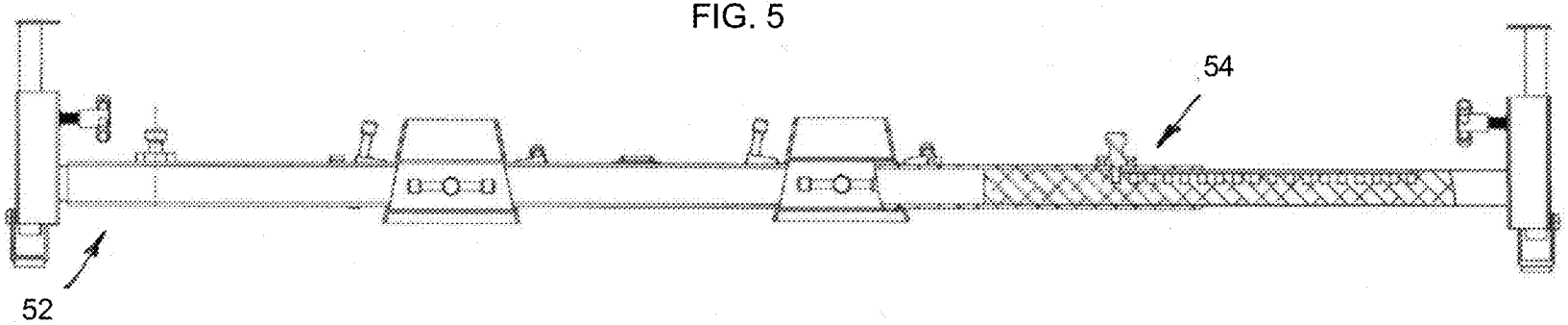

Referring to FIGS. 5 and 6 a second embodiment is illustrated. The only variation is the outriggers in this case have telescopic end sections 51, 52. These employ incremental holes 53 and a retractable pin 54 used to set and fix the length of the outrigger. In this case the minimum outrigger length is about the same as in the previous embodiment but may be extended using the telescopic sections.

Figure 7:
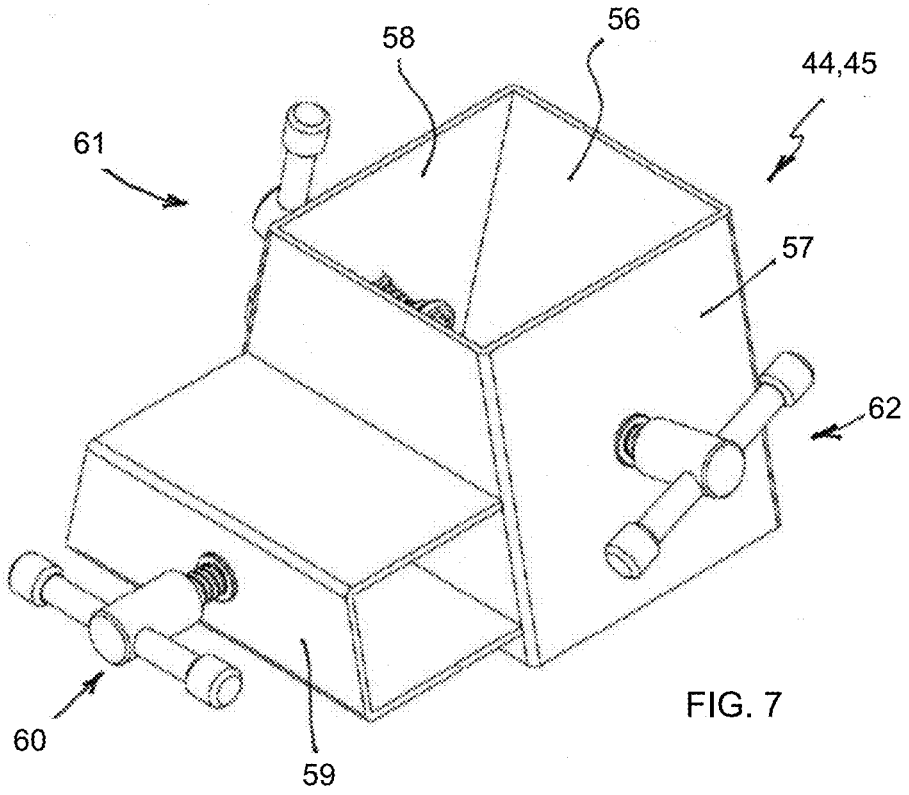
FIG. 7 is a top perspective view of a rail receiving clamp section suitable for the stabilizers of FIGS. 1 through 6.
Figure 8:
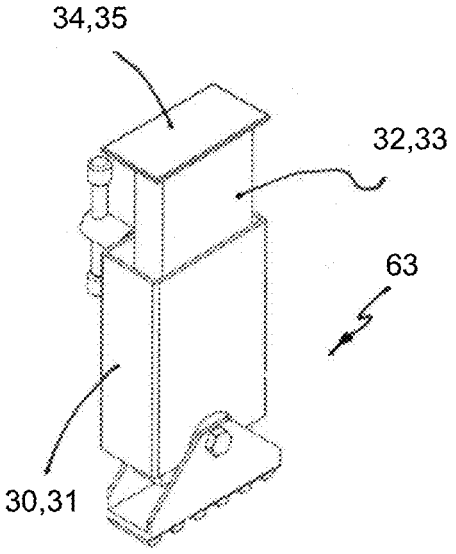
FIGS. 8 and 9 are opposed perspective views of a typical foot assembly.
Figure 9:
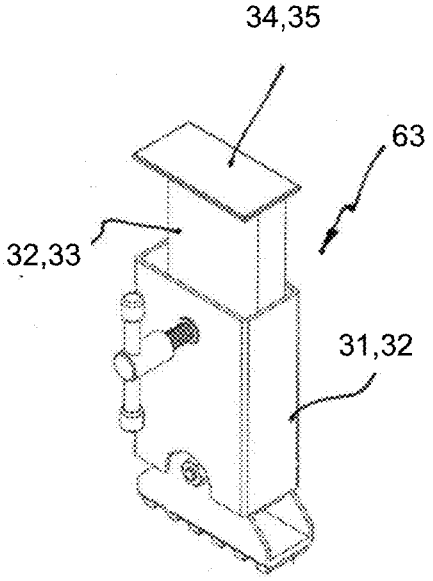
Figure 10:
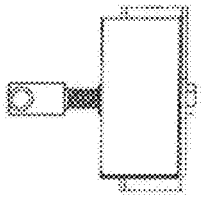
FIGS. 10 through 13 are top side end and opposite side views of a foot assembly according to FIGS. 8 and 9.
Figure 11:
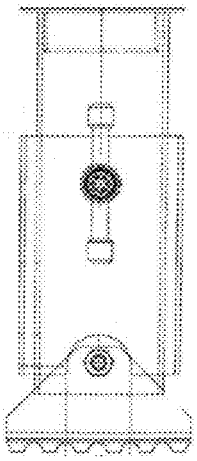
Figure 12:
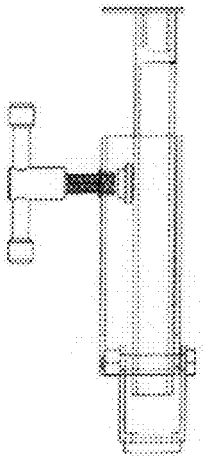
Figure 13:
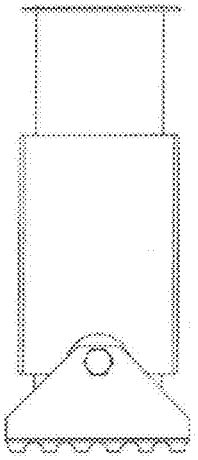
Figure 14:
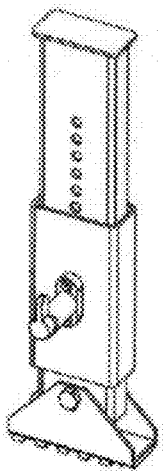
FIG. 14 is an alternative foot assembly.

A typical rail housing and rail collar assembly is illustrated in greater detail in FIG. 7. The housing has parallel sides 55, 56 and non-parallel sides 57, 58 and welded to this is a rail collar 59. By securing the leg assemblies to the rail 40, the housings are held captive as soon as the safety stops are welded or secured to the rail. Hand clamps 60, 61 and 62 are employed so in this case the housing is an isosceles trapezium pyramid configuration.

The rail 40 is able to wobble in the horizontal direction but is a snug but freely slidable fit in the vertical direction in the collar 59. The hand clamps provide for continuous adjustment and fine tuning of the overall clamp position of the ladder rails relative to the ground engaging relationship of the stabilizer between the ladder and the ground.

FIGS. 8 to 13 show more detail on the leg and foot assembly at 63. The collar 30, 31 and leg sections 32, 33 have a snug but freely slidable fit in the width of the leg but may wobble in the narrow dimension until clamped. The stop or cap 34, 35 and the pivot footing 18, 19 prevent the leg from being removed. Thus it will be appreciated that all the parts are non removably connected.

Whilst the above has been given by way of illustrative example many variations and modifications will be apparent to those skilled in the art without departing from the broad ambit and scope of the invention as herein set out in the appended claims where the invention and the improvements are claimed.

What is claimed is:

1. A ladder stabilizer for a ladder having rails and rungs and in use a top and a bottom comprising, spaced apart rail receiving clamp sections, bilateral outriggers extending from the rail receiving clamp sections, each outrigger having at least one ground engaging foot, each ground engaging foot being height adjustable, the stabilizer being so dimensioned and arranged that rails of a ladder are clampable in the clamp sections so that the outriggers and feet stabilize the ladder against titling by providing bilateral resistive forces and moments extending substantially along a line across the bottom of the ladder; wherein the ladder has an axis between the top and bottom, and the rail receiving clamp sections have a narrow upper neck with sideways clamps that apply a sideways clamp force so that the stabilizer is tiltable relative to the ladder axis and still clamped to the rails; and wherein the rail receiving clamp sections each comprise a collar that is trapezium prismatic in shape.

2. The ladder stabilizer according to claim 1 wherein the sideways clamps comprise manually operable clamps that are adapted to apply a clamping force to a rail in a direction along the line across the bottom of the ladder, and are non-removable.

3. The ladder stabilizer according to claim 1 wherein the rail receiving clamp sections have rail pass though passages so that a ladder rail can pass through and contact ground below the ladder.

4. The ladder stabilizer according to claim 1 wherein the rail receiving clamp sections are configured to accommodate different size rails.

5. The ladder stabilizer according to claim 1 wherein the rail receiving clamp sections are laterally slidable.

6. The ladder stabilizer according to claim 1 wherein the rail receiving clamp sections are able to freely slide along an axial guideway.

7. The ladder stabilizer according to claim 1 wherein each rail receiving clamp section has a guide fitted to a smaller guideway which is freely slidable until the guide is clamped to the smaller guideway.

8. The ladder stabilizer according to claim 1 wherein the sideways clamps each comprise two hand clamps, such that one is operative on each side of a ladder rail.

9. The ladder stabilizer according to claim 1 wherein the ground engaging feet are at-ends of respective slidable legs, each leg being slidable in a leg guideway.

10. The ladder stabilizer according to claim 1 wherein the ground engaging feet are at-ends of respective slidable and clampable legs, each of the legs being freely slidable in a guideway so that they are adapted to wobble until clamped.

11. The ladder stabilizer according to claim 1 wherein the ground engaging feet are at ends of respective slidable and clampable legs, each of the legs being freely slidable in a guideway so that they are adapted to wobble until clamped, each guideway having a clamp that is configured to apply a clamp force in a horizontal direction.

* * * * *